United States Patent [19]

Boggs et al.

[11] 4,001,547

[45] Jan. 4, 1977

[54] ELECTRIC HEATING ELEMENTS

[75] Inventors: Alben C. Boggs; Robert D. Shirey, both of Pittsburgh, Pa.

[73] Assignee: Emerson Electric Co., St. Louis, Mo.

[22] Filed: Dec. 22, 1975

[21] Appl. No.: 642,682

[52] U.S. Cl. ..... 219/322; 29/611; 219/335; 317/9 AC; 338/228

[51] Int. Cl.[2] ..... F24H 1/00

[58] Field of Search ..... 219/316, 318, 322, 335, 219/336, 481, 363, 523, 536; 338/317, 228, 21; 317/9 A, 9 AC, 9 R, 31; 29/611, 610

[56] References Cited

UNITED STATES PATENTS

| | | | |
|---|---|---|---|
| 2,614,200 | 10/1952 | McNair | 317/9 A X |
| 3,859,721 | 1/1975 | Cunningham et al. | 219/336 |
| 3,916,145 | 10/1975 | Skinner | 219/335 |

*Primary Examiner*—C. L. Albritton
*Attorney, Agent, or Firm*—Michael Williams

[57] ABSTRACT

Our invention relates to electric heating elements for heating liquid within a tank, and particularly to heating elements for use in domestic commercial water tanks, wherein the element comprises a metal mounting member secured to the wall of the tank and a sheath portion carried by the mounting member and extending through a hole in the tank wall for immersion in the water in the tank. The sheath portion contains a resistance conductor and insulation which electrically insulates the conductor from the sheath, so that water in the tank is heated when the resistance conductor is electrically connected to a source of electrical energy.

Our invention provides means for protecting the electric heating element from damage which may otherwise be caused by a sudden surge of high voltage, such as that which may be caused by lightning disturbances in the immediate vicinity.

9 Claims, 7 Drawing Figures

34
33
32
31
43
18
15
12
10
11
14
15.1
12
18
21
43
34
17

34
34
21
24
25
23
25
24
23
34
17
34

21
4
43
20
17
20
22
24
41
19
18
12
15
42
15.1
23
20
42
41
24
22
19
15.1
18
12
15
4
43
40

12
21
43
18
41
12
43
18
41

51
6
50
18a
6
51
18a 51
18a
51
18a 17
19
12
18
15.1
52
53

ELECTRIC HEATING ELEMENTS

BACKGROUND AND SUMMARY

Electric water heating elements are normally connected to the wall of a water tank and are well grounded to earth because the tank is well grounded by reason of its water pipe connections.

We have discovered that many types of water heating elements are susceptable to damage by surges of high voltage, such as may be caused by lightning disturbances. Such surges may cause a puncture in the sheath of the heating element which eventually causes the end seal in the sheath to leak, whereby water from the tanks leaks outwardly of the sheath to the area adjacent to the tank to cause water damage and resultant liability claims.

To minimize the probability of sheath puncture, and consequent damage, we incorporate a spark gap into the present heater design which will harmlessly shunt high voltage surges to ground, and thereby limit the level of overvoltage impressed on the electrical insulation inside the sheathed heater. Our invention provides this overvoltage protection without materially increasing the cost of manufacture of presently known electric water heater constructions.

DESCRIPTION OF THE DRAWING

In the drawing accompanying this specification, and forming a part of this application, there are shown, for purposes of illustration, embodiments which our invention may assume, and in this drawing.

DESCRIPTION OF THE PREFERRED EMBODIMENT

Figure 1:
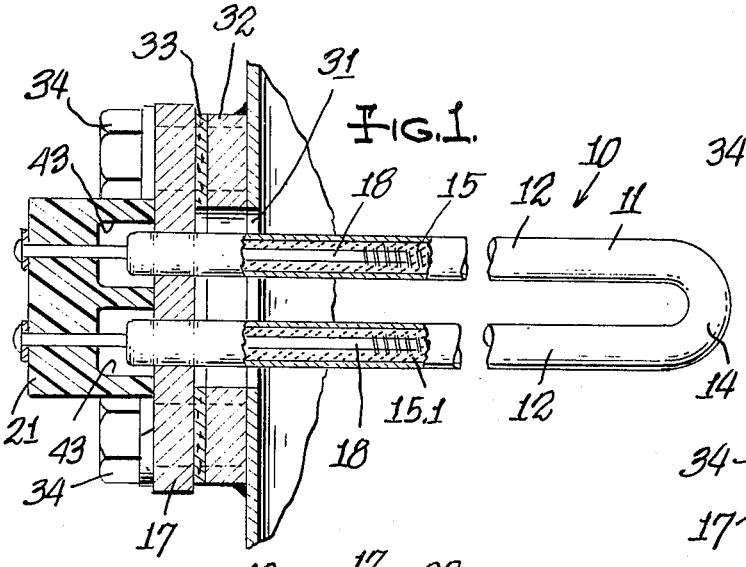
FIG. 1 is a fragmentary, sectional view through a water tank showing a conventional electric water heater connected to the wall of the tank, the heater incorporating our invention.
Figure 2:
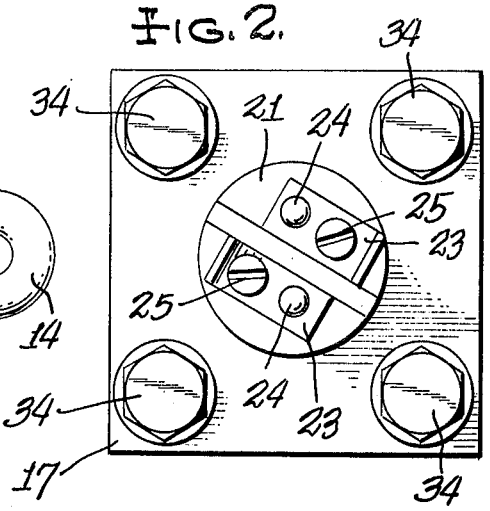
FIG. 2 is an end view of the water heater, looking from the left of FIG. 1.

The electric water heater 10 shown in FIG. 1 is of the well-known hair-pin type, and comprises a metal sheath 11 having a pair of generally parallel legs 12 connected by a bight 14. Disposed within the sheath is a resistance wire 15 which is normally in the form of a helical coil. Compacted granular refractory material 15.1, such as magnesium oxide, electrically insulates the resistance coil from the sheath, but conducts heat from the former to the latter.

The ends of the sheath legs extend through respective openings in a mounting member, such as the steel flange 17. Each of a pair of terminal pins 18 (see also FIG. 3) has its inner end electrically connected to a respective end of the helical coil, and each extends beyond the respective sheath leg. A plastic bushing 19 is secured within the end of each leg to seal such end. Normally, the sheath ends are connected to the flange 17 by staking indentations 20 to lock the bushings in place and to secure the leg ends within the holes in the flange in sealing relation.

A terminal block 21 is positioned to overlie the outwardly directed face of the flange 17 and has holes 22 therethrough to pass respective terminal pins. Two terminal bars 23 are seated against the outwardly facing surface of the terminal block and each has an opening to pass the outer end of a respective terminal pin. The end of each pin is headed at 24, such as by an heliarc weld, to maintain the terminal clip assembled with the heater construction. Each terminal bar has a threaded hole for receiving a screw 25, the latter being utilized to secure a current conductor (not shown) to a respective terminal bar.

The electric water heater above described is held assembled to the metal wall of a conventional water tank in a manner to provide good electrical contact therebetween. As shown in FIG. 1, the metal tank wall 30 has an opening 31 therein to pass the legs 12—12 of the heating element. Since the tank wall is usually of light gauge metal, a reinforcing metal ring 32 is welded around the opening 31. A gasket 33 is disposed between facing surfaces of the ring 32 and flange 17 to prevent leakage of water through the tank opening 31. The flange 17 is rigidly held to the tank wall by means of bolts 34 which pass through openings in the peripheral portion of the flange and are threaded into corresponding openings in the ring 32.

It will therefore be evident that the metal sheath 10 and metal flange 17 are in good electrical continuity with the metal wall 30 of the water tank. Copper pipe connections (not shown) are normally made to the tank for the purpose of delivering cold water to and removing hot water from the tank, and such pipe connections are normally well grounded to earth, so that the water tank and electric heating element are equally well grounded.

As before noted, the terminal bars 23, by means of the screws 25, are connected to respective power lines (not shown) which lead to a source of electrical energy. The power lines include wiring within the dwelling and lines extending from the dwelling to a power source, such as the usual pole-mounted transformer. The power lines are subject to occasional surges of high voltage, such as may be caused by atmospheric lightning disturbances or malfunction of a voltage regulator, and such surges have heretofore provided a cause of damage to the electric heating element. As an example, if either line connected to the respective terminal bars is subjected to a high voltage impulse, such impulse would be carried inside a sheath leg by a terminal pin and cause a break down in insulating value in the refractory material surrounding the inner portion of the terminal pin. This breakdown may cause the sheath to be punctured at the point of insulation breakdown. Since the sheath is immersed in water in the tank, such water would enter the sheath and hydrate the magnesium oxide which in turn expands and causes splitting of the sheath in a direction toward a leg end. As the sheath splits, the sealing effect of the plastic bushing deteriorates, and eventually water will leak past the bushing and outwardly of the leg end, and accumulate in the area surrounding the water tank.

Although our invention is shown as applied to a water heating element having a mounting flange 17, it will be appreciated that the mounting support may take different forms, such as screw-plug or clamp-type supports.

In order to protect the heater against damage which may be caused by high voltage surges, we introduce a spark gap in the heater structure to shunt such surge harmlessly to ground and thereby limit the level of overvoltage impressed on the electrical insulation within the sheath of the heater.

Figure 3:
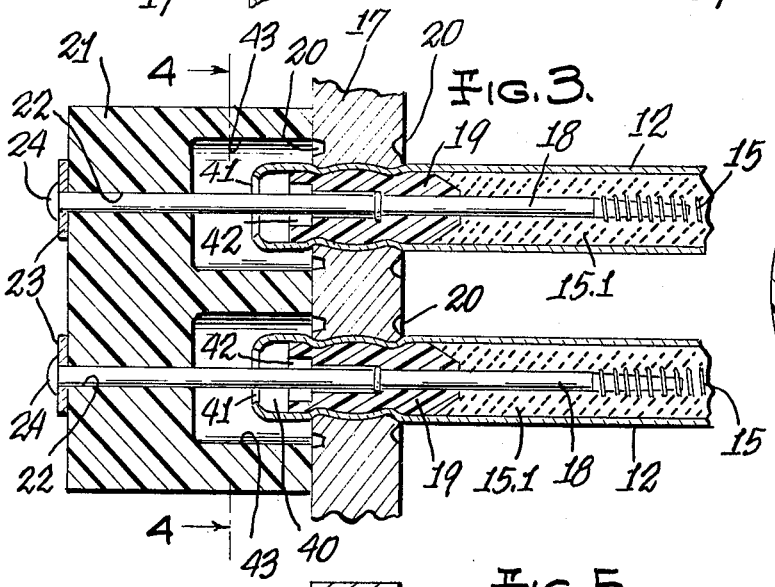
FIG. 3 is an enlarged, fragmentary longitudinal sectional view, showing an embodiment of our invention.

As seen FIG. 3, the outer end of the plastic bushing 19 is disposed inwardly of the sheath leg to provide a space 40, and the extremity of the sheath leg is turned inwardly a predetermined amount to form a spark gap 41 with the adjoining surface of the terminal pin. It is preferable that spark gaps 41 are provided at each terminal end of the heater since it is not possible to predict which current-source line may carry the highest impulse voltage. It will also be noted that each spark gap is located away from any plastic that may suffer damage by surface tracking if the spark were permitted to follow the plastic surface. Therefore, the bushing 19 is disposed inwardly of the end of the sheath leg to provide the space 40, and is additionally formed with an end recess 42. The terminal block 21, which is also formed of plastic material, is provided with recesses 43 to space the plastic from the spark gaps.

Figure 4:
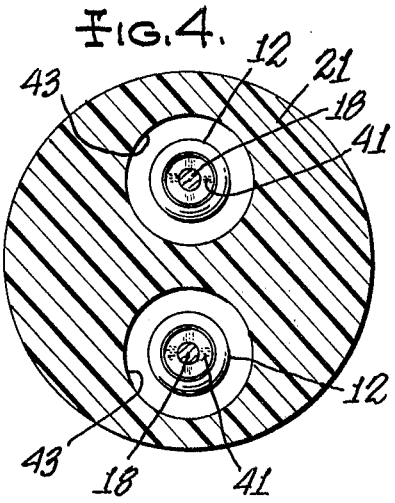
FIG. 4 is a transverse sectional view, corresponding to the line 4—4 of FIG. 3.

The spark gap protection at each terminal end of the heater may be formed without materially increasing the cost of the heater. In the embodiment disclosed in FIGS. 1 through 4, this may be accomplished by a simple die operation prior to the time the terminal block 21 is assembled with the terminal pins 18. Since the gap space is critical, suitable gauges (not shown) may be used to establish a predetermined annular space between the terminal pin 18 and the end of the sheath leg. For normal uses, it has been determined that the gap should be of a size so that air will break down and a spark will pass when the impressed voltage is about 2500 plus volts. Therefore, under ordinary conditions, the water heater will function in normal manner. However, when a sudden surge of overvoltage is applied to either line leading to the heater, sparking will occur, as suggested by the dotted lines in FIG. 4, and such overvoltage is harmlessly shunted to ground and thereafter the heater will function in normal manner.

Figure 5:
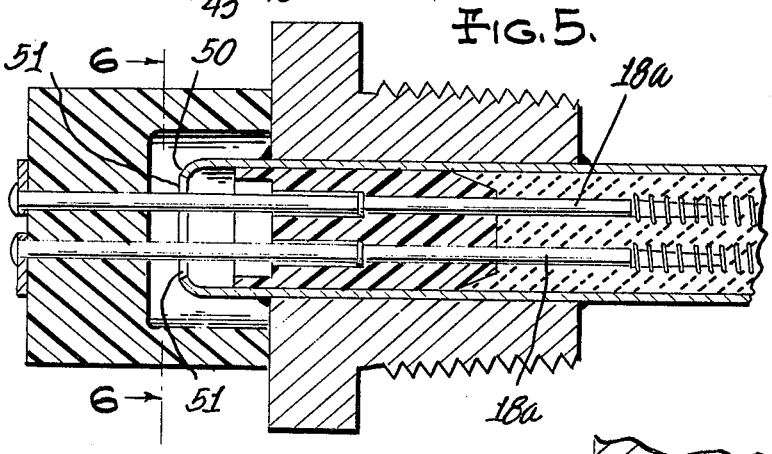
FIG. 5 is a fragmentary, longitudinal sectional view, disclosing another type of water heater in which our invention is incorporated.
Figure 6:
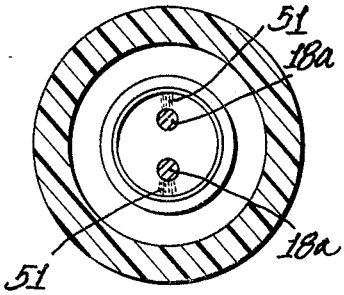
FIG. 6 is a transverse sectional view, corresponding to the line 6—6 of FIG. 5.

The structure disclosed in FIGS. 5 and 6 discloses use of a spark gap for the same purpose, in a heating element of slightly different construction and utilizing a screw plug instead of a mounting plate as the mounting member. The heating element in this case has a rectilinear sheath with both terminal pins 18*a* extending outwardly from one end of the sheath, the opposite end being closed. As shown at 50, the outer end of the sheath is turned inwardly toward, but spaced a predetermined amount from, the two terminal pins, so that a pair of spark gaps 51 are formed, one in combination with each terminal pin.

DESCRIPTION OF OTHER EMBODIMENT

Figure 7:
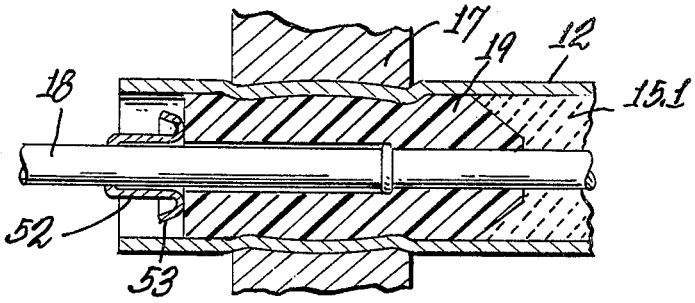
FIG. 7 is a fragmentary, longitudinal sectional view of a water heater, showing another embodiment of our invention.

The heater construction shown in FIG. 7 is substantially similar to that shown in FIG. 3 and like reference numerals are used to refer to similar parts. In this embodiment, however, the outer end of each sheath leg 12 is not turned inwardly, as before. Instead, a metal eyelet 52 is pushed onto each terminal pin 18, the eyelet having an opening to receive the terminal pin and having the usual wall 53, the end margin of which is held in proper spark-gap distance from the inner surface of the sheath. Instead of an eyelet, the spark-gap forming member may be a metal clip of U-shape.

We claim:

1. In an electric immersion heating element having a metal sheath, a resistance conductor within said sheath and electrically insulated therefrom, said resistance conductor having a terminal end partly within an outer end portion of said sheath and extending outwardly of an open end of said sheath at said end portion, said heating element also having a metallic mounting member mechanically and electrically connected to said sheath at said outer end portion, said mounting member being connectable to the metal wall of a grounded container in electrical continuity therewith, said mounting member supporting said sheath for extension through an opening in said wall so that an inner portion of said sheath is immersed in fluid within said container, the improvement comprising:

means for protecting said heating element from damage in the event the latter is subjected to voltage which is in excess of its range of normal operating voltage, said protecting means comprising a spark gap between said sheath outer end portion and said terminal end of said resistance conductor, said gap being of a size to conduct voltage only when said conductor terminal end is subjected to voltage beyond the range of the normal operating voltage of said heating element, whereby the voltage so conducted is harmlessly led to ground via said sheath, said mounting member and said container, without damage to said heating element.

2. The construction according to claim 1 wherein said resistance conductor is mechanically and electrically connected to a terminal pin and the latter provides said terminal end of said resistance conductor, and wherein said spark gap is formed by adjoining but spaced parts of said sheath outer end and said terminal pin.

3. The construction according to claim 2 wherein a plastic bushing is disposed within said sheath outer end and has an opening to pass said terminal pin, said bushing fitting against the interior surface of said sheath outer end and the peripheral surface of said terminal pin to seal against passage of deleterious matter to the interior of said sheath, said spark gap being located sufficiently away from any part of said bushing to prevent surface tracking of the spark along said bushing.

4. The construction according to claim 1, wherein said spark gap is formed by turning in the sheath at its open end so that the turned-in portion is directed toward, but spaced from, said terminal end.

5. The construction according to claim 4 wherein said mounting member has an opening in which said sheath end portion is disposed in sealed relation, with said end portion projecting from a side surface of said mounting member, and further including a plastic terminal block held in position with a surface abutting said mounting member side surface, said terminal block having an opening to pass said terminal pin, said terminal block opening having an enlargement at its said surface to space any part of said terminal block away from said spark gap and thereby prevent surface tracking of the spark along said terminal block.

6. The construction according to claim 1 wherein said heating element is of the hair-pin type, providing two sheath legs, each having an outer end portion connected to said mounting member, said resistance conductor having a pair of terminal ends, each disposed within the outer end portion of a respective sheath leg, and a spark gap between the outer end portion of each sheath leg and the respective terminal end of said resistance conductor.

7. The construction according to claim 1 wherein a terminal pin is connected to each of the opposite ends of said resistance conductor, the two terminal pins being disposed in laterally spaced relation and electrically insulated from each other and said sheath outer end portion, said sheath having its open end turned inwardly so that the turned-in portion is directed toward, but spaced from each terminal pin to provide a spark gap therebetween.

8. The construction according to claim 1 wherein said resistance conductor is mechanically and electrically connected to a terminal pin and the latter provides said terminal end of said resistance conductor, and further including a metal member having tight engagement on said terminal pin, said metal member having a portion directed toward, but spaced, from the interior surface of said sheath outer end portion to form a spark gap therebetween.

9. The method of protecting a sheathed electric immersion heating element of conventional construction against damage which may be caused by application of voltage in excess of the range of normal operating voltage, wherein said heating element has the usual metallic mounting member which is mechanically and electrically secured to an outer portion of the metal sheath and is mechanically and electrically securable to the metal wall of a grounded container to support the sheath for extension through an opening in said wall so that an inner portion is immersed in fluid within said container, said heating element further having a resistance conductor within said sheath and a terminal pin connected to said resistance conductor inwardly of said sheath and extending outwardly of an open end at said outer sheath portion, said resistance conductor and said terminal pin being electrically insulated from said sheath and said terminal pin and said sheath having uninsulated portions in spaced relation, the improved method comprising:

establishing a spark gap between the uninsulated portions of said terminal pin and sheath of a predetermined size to pass only voltage impressed on said terminal pin which is in excess of the range of normal operative voltage of said heating element, whereby said excess voltage is harmlessly led to ground via said sheath, said mounting member and said container, without damage to said heating element.

* * * * *